US007742027B2

(12) United States Patent
Yamashita et al.

(10) Patent No.: US 7,742,027 B2
(45) Date of Patent: Jun. 22, 2010

(54) PIXEL CIRCUIT AND DISPLAY APPARATUS

(75) Inventors: Junichi Yamashita, Tokyo (JP); Tetsuo Minami, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 113 days.

(21) Appl. No.: 11/898,263

(22) Filed: Sep. 11, 2007

(65) Prior Publication Data

US 2008/0074363 A1 Mar. 27, 2008

(30) Foreign Application Priority Data

Sep. 25, 2006 (JP) ..... 2006-259572

(51) Int. Cl.
*G09G 3/36* (2006.01)

(52) U.S. Cl. ..... 345/87; 345/80; 345/92

(58) Field of Classification Search ..... 345/36, 345/38–39, 45, 76–78, 82–84, 87–88, 90–95, 345/98–100, 204–205, 210–214; 315/169.1, 315/169.3

See application file for complete search history.

(56) References Cited

U.S. PATENT DOCUMENTS

| | | | | |
|---|---|---|---|---|
| 5,952,789 | A * | 9/1999 | Stewart et al. | 315/169.4 |
| 6,153,836 | A * | 11/2000 | Goszyk | 178/19.01 |
| 6,229,506 | B1 * | 5/2001 | Dawson et al. | 345/82 |
| 6,229,508 | B1 * | 5/2001 | Kane | 345/82 |
| 6,583,775 | B1 * | 6/2003 | Sekiya et al. | 345/76 |
| 7,259,735 | B2 * | 8/2007 | Kasai | 345/77 |
| 2006/0186824 | A1 * | 8/2006 | Sun | 315/169.3 |

FOREIGN PATENT DOCUMENTS

| | | |
|---|---|---|
| JP | 2003-255856 | 9/2003 |
| JP | 2003-270660 | 9/2003 |
| JP | 2003-271095 | 9/2003 |
| JP | 2004-029791 | 1/2004 |
| JP | 2004-093682 | 3/2004 |
| JP | 2004-133240 | 4/2004 |
| JP | 2005-070803 | 3/2005 |
| JP | 2005-148749 | 6/2005 |
| JP | 2006-163371 | 6/2006 |

OTHER PUBLICATIONS

Japanese Office Action issued Sep. 9, 2008 for corresponding Japanese Application No. 2006-259572.

* cited by examiner

*Primary Examiner*—Richard Hjerpe
*Assistant Examiner*—Mansour M Said
(74) *Attorney, Agent, or Firm*—Rader, Fishman & Grauer

(57) ABSTRACT

Disclosed herein is a pixel circuit, including: three pixels to which three primary colors are allocated; and a power supply line. In the pixel circuit, each of the three pixels includes a sampling transistor configured to sample an image signal, a retaining capacitor configured to retain the sampled image signal, a drive transistor configured to output drive current corresponding to the retained image signal within a predetermined light emission period, and a light emitting element configured to emit light in the color allocated to the three pixels in response to the drive current. The pixel circuit includes a single switching transistor disposed commonly to the three pixels for connecting the drive transistors of the pixels to the power supply line within the light emission period.

8 Claims, 14 Drawing Sheets

$$Ids = k\mu\,(Vgs-Vth)^2 = k\mu\,(Vsig-\Delta V)^2$$

PIXEL CIRCUIT AND DISPLAY APPARATUS

CROSS REFERENCES TO RELATED APPLICATIONS

The present invention contains subject matter related to Japanese Patent Application JP 2006-259572 filed in the Japan Patent Office on Sep. 25, 2006, the entire contents of which are incorporated herein by reference.

BACKGROUND OF THE INVENTION

1. Field of the Invention

The present invention relates to a pixel circuit including three pixels to which light emitting elements which emit light of three primary colors are allocated and a power supply line for supplying current to the light emitting elements and a display apparatus wherein such pixel circuits are arranged in a matrix. More particularly, the present invention relates to a technique for reducing the number of elements which compose a pixel circuit to simplify the circuit configuration.

2. Description of the Related Art

In an image display apparatus, such as a liquid crystal display unit, a great number of liquid crystal pixels are arranged in a matrix and the transmission intensity or reflection intensity of incoming light is controlled for each pixel in accordance with information of an image to be displayed so that the image is displayed. While the displaying method just described similarly applies also to an organic EL (electroluminescence) display unit wherein organic EL elements are used as pixels or to a like apparatus, an organic EL element is a self light emitting element, different from a liquid crystal pixel. Therefore, when compared with the liquid crystal display unit, the organic EL display unit is advantageous in that the visibility of an image is high, a backlight need not be provided, the speed of response is high, and so forth. Further, the organic EL display unit is of the current controlled type wherein the luminance level (gradation) of each light emitting element can be controlled by the value of current supplied thereto. In this regard, the organic EL display unit is very different from a display unit of the voltage controlled type such as a liquid crystal display unit.

In an organic EL display unit, a simple matrix system and an active matrix system are utilized as a driving system similarly as in a liquid crystal display unit. The former system has a problem that, while it is simple in structure, it is difficult to implement a large-sized and high-definition display unit. Therefore, at present, much effort is directed to the development of organic EL display units of the active matrix system. According to the active matrix system, current to be supplied to light emitting elements in the inside of each pixel circuit is controlled by an active element (generally, thin film transistor, TFT) provided in the inside of the pixel circuit. An organic EL display unit of the active matrix system is disclosed in Japanese Patent Laid-Open No. 2003-255856, Japanese Patent Laid-Open No. 2003-271095, Japanese Patent Laid-Open No. 2004-133240, Japanese Patent Laid-Open No. 2004-029791, or Japanese Patent Laid-Open No. 2004-093682.

SUMMARY OF THE INVENTION

In order to implement a color display on such an organic EL display unit as described above, a plurality of pixels are arranged in a matrix wherein each three pixels to which light emitting elements which emit light of three primary colors (red (R), green (G) and blue (B)) are allocated are arranged as one set (trio). In an existing color display apparatus, pixel circuits are formed independently of each other among RGB pixels. Therefore, according to a simple calculation, the total number of active elements which compose pixel circuits is as high as three times that of an organic EL display unit of the monochromatic display type, and this decreases the yield of a panel which composes the organic EL display unit as much. Further, numberless active elements (generally, thin film transistors (TFTs)) have to be integrally formed on a panel whose area is limited, and this makes an obstacle to the arrangement of pixels for higher definition. Further, there is a subject that the fabrication cost increases as the number of devices increases.

Therefore, it is demanded to provide a pixel circuit and a color display apparatus wherein the circuit configuration is simplified to reduce the total number of elements, thereby to achieve an improvement of the yield of a display panel, an arrangement of pixels for higher definition and a reduction of the fabrication cost.

According to an embodiment of the present invention, there is provided a pixel circuit including three pixels to which three primary colors are allocated and a power supply line. Each of the three pixels includes a sampling transistor configured to sample an image signal, a retaining capacitor configured to retain the sampled image signal, a drive transistor configured to output drive current corresponding to the retained image signal within a predetermined light emission period, and a light emitting element configured to emit light in the color allocated thereto in response to the drive current. The pixel circuit includes a single switching transistor disposed commonly to the three pixels for connecting the drive transistors of the pixels to the power supply line within the light emission period.

Preferably, the pixels include different supplementary capacitors having capacitance values different from each other for supplementing the retaining capacitors, and the switching transistor is disposed in that one of the pixels which includes the supplementary capacitor which has the lowest one of the capacitance values.

Preferably, the switching transistor is connected to the three drive transistors of the three pixels with a multi-layer wiring line.

According to another embodiment of the present invention, there is provided a display apparatus in the form of a panel, including a plurality of pixels arranged in a matrix in a unit of three pixels to which three primary colors are allocated and a power supply line configured to supply power to the pixels. Each of the three pixels to which the three primary colors are allocated includes a sampling transistor configured to sample an image signal, a retaining capacitor configured to retain the sampled image signal, a drive transistor configured to output drive current in response to the retained image signal within a predetermined light emission period, and a light emitting element configured to emit light in the color allocated thereto in response to the drive current. The display apparatus includes a single switching transistor disposed commonly to the three pixels and configured to connect the drive transistors of the three pixels to which the three primary colors are allocated to the power supply line within the light emission period.

In the pixel circuit and the display apparatus, switching transistors for light emission period control individually provided in a red pixel (R pixel), a green pixel (G pixel) and a blue pixel (B pixel) in an existing pixel circuit and display apparatus are reduced to one switching transistor which is commonly used for the R pixel, the G pixel and the B pixel. Consequently, a reduction of the total number of elements is achieved. Also, the number of power supply lines wired individually for the R, G and B pixels in the existing pixel circuit and display apparatus can be reduced to one by such common use of the switching transistor. This makes it possible to achieve an arrangement of pixel circuits for higher definition, an improvement of the yield of a panel and a reduction of the fabrication cost. Further, also, a short-circuiting defect can be prevented by the reduction of the number of elements and the number of wiring lines. In addition, by the common use of the switching transistor to the R, G and B pixels, such a characteristic dispersion of switching transistors as in the R, G and B pixels of an existing pixel circuit and display apparatus is eliminated. Consequently, the dispersion in luminance among the R, G and B pixels can be suppressed.

DETAILED DESCRIPTION OF THE PREFERRED EMBODIMENT

Figure 1:
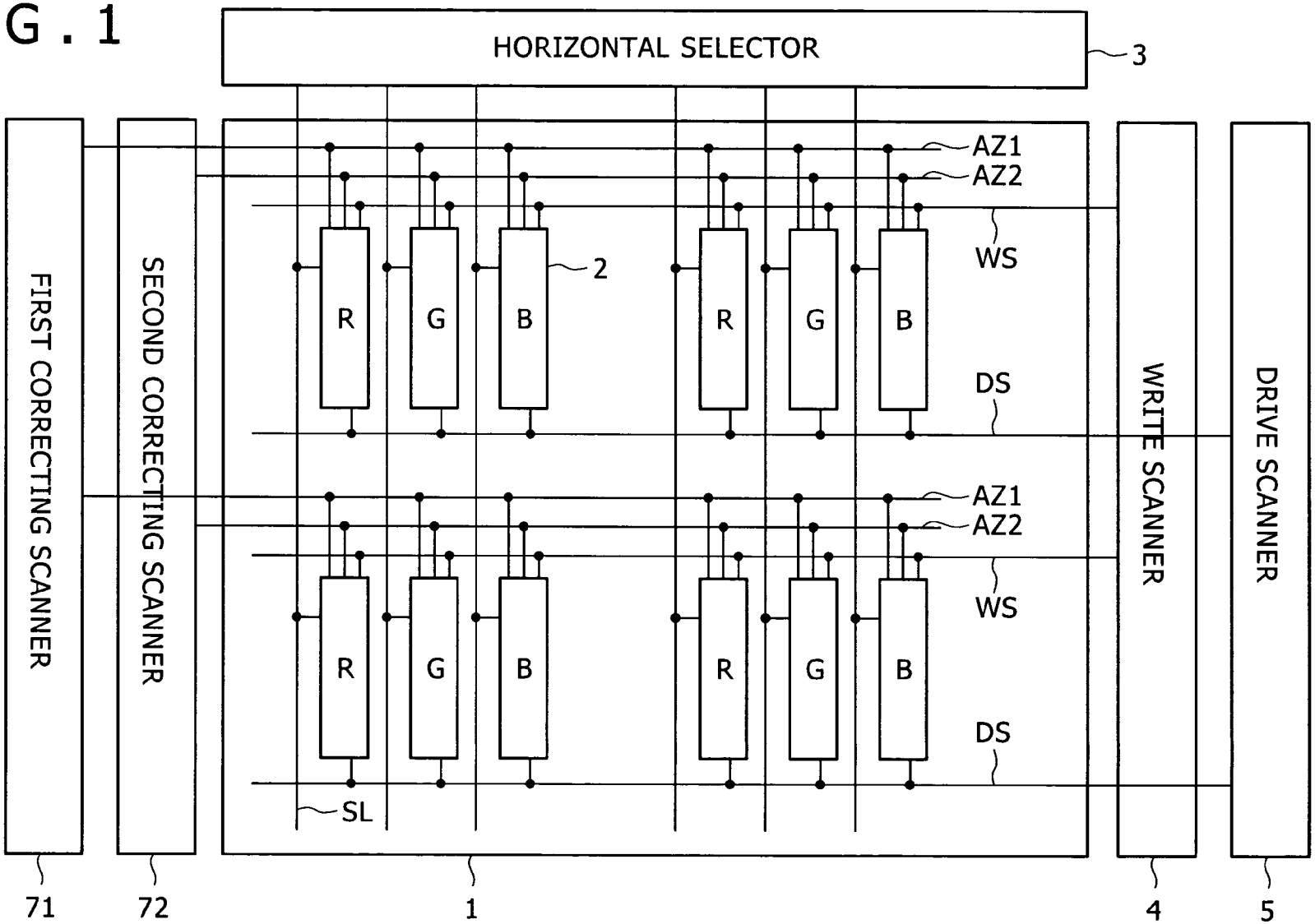
FIG. 1 is a block diagram showing a general configuration of an image display apparatus which includes a pixel circuit according to an embodiment of the present invention.

Referring first to FIG. 1, there is shown a general configuration of a display apparatus to which the present invention is applied. The display apparatus shown is basically composed of a pixel array section 1 and a driving section including a scanner section and a signal section. The pixel array section 1 includes scanning lines WS, AZ1, AZ2 and DS arranged in rows, signal lines SL arranged in columns, and a plurality of pixels 2 arranged in a matrix and connected to the scanning lines WS, AZ1, AZ2 and DS and signal lines SL. The pixel array section 1 further includes a plurality of power supply lines for supplying a first potential Vss1, a second potential Vss2 and a third potential Vcc necessary for operation of the pixels 2. The three RGB primary colors are allocated to the pixels 2, and such pixels 2 are individually referred to sometimes as R pixel, G pixel and B pixel, respectively. The first potential Vss1 necessary for operation of the pixels 2 is used for a predetermined potential setting, and also the second potential Vss2 is used for a predetermined potential setting. Different from the potentials Vss1 and Vss2, the third potential Vcc functions as a power supply for supplying current to the pixels 2. On the other hand, the signal section includes a horizontal selector 3 and supplies an image signal to the signal lines SL. The scanner section includes a write scanner 4, a drive scanner 5, a first correction scanner 71 and a second correction scanner 72, and supplies control signals to the scanning lines WS, scanning lines DS, scanning lines AZ1 and scanning lines AZ2 to successively drive the pixels 2 for each row.

Figure 2:
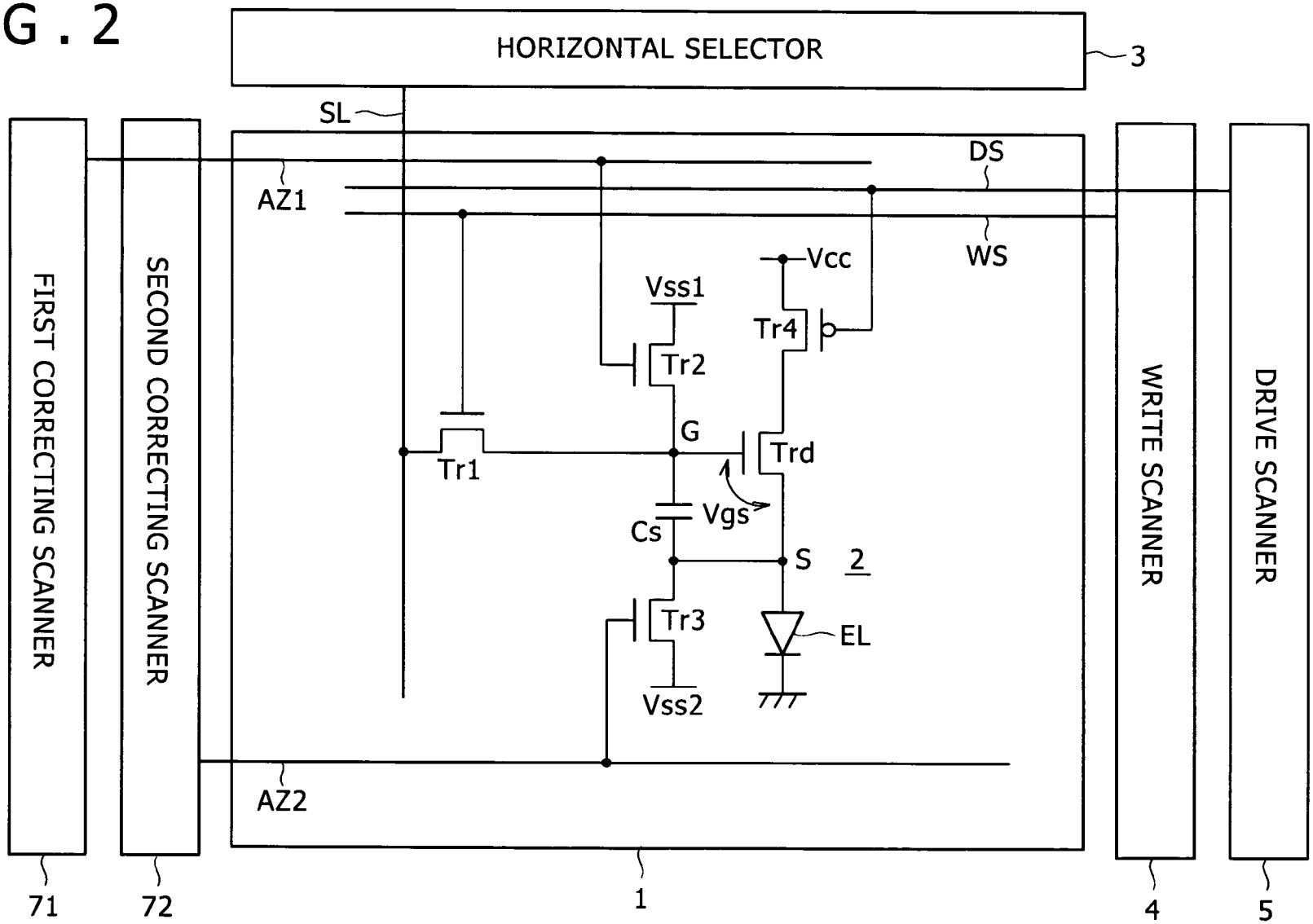
FIG. 2 is a circuit diagram showing a pixel circuit which is utilized as a base for the pixel circuit according to an embodiment of the present invention.

FIG. 2 is a circuit diagram showing an example of a configuration of a pixel 2 formed on the image display apparatus shown in FIG. 1. It is to be noted that, since the configuration of the pixel circuit shown in FIG. 2 is utilized as a base of the present invention, it is described in detail below. Referring to FIG. 2, the pixel circuit 2 includes a sampling transistor Tr1, a drive transistor Trd, a first switching transistor Tr2, a second switching transistor Tr3, a third switching transistor Tr4, a pixel capacitor Cs, and a light emitting element EL. The sampling transistor Tr1 conducts in response to the control signal supplied thereto from the corresponding scanning line WS within a predetermined sampling period and samples the signal potential of the image signal supplied thereto from the corresponding signal line SL into the pixel capacitor Cs. The pixel capacitor Cs applies an input voltage Vgs to the gate G of the drive transistor Trd in response to the signal potential of the sampled image signal. The drive transistor Trd supplies an output current Ids corresponding to the input voltage Vgs thereto to the light emitting element EL. The light emitting element EL emits light with a luminance in response to the signal potential of the image signal in accordance with the output current Ids supplied thereto from the drive transistor Trd within a predetermined light emission period.

The first switching transistor Tr2 conducts in response to a control signal supplied thereto from the scanning line AZ1 prior to a sampling period to set the gate G of the drive transistor Trd to the first potential Vss1. The second switching transistor Tr3 conducts in response to a control signal supplied from the scanning line AZ2 prior to a sampling period to set the source S of the drive transistor Trd to the second potential Vss2. The third switching transistor Tr4 conducts in response to a control signal supplied thereto from the scanning line DS prior to a sampling period to connect the drive transistor Trd to the third potential Vcc so that a voltage corresponding to the threshold voltage Vth of the drive transistor Trd is retained into the pixel capacitor Cs to eliminate the influence of the threshold voltage Vth. Further, the third switching transistor Tr4 conducts in response to the control signal supplied thereto from the scanning line DS again within a light emission period to connect the drive transistor Trd to the third potential Vcc so that the output current Ids is supplied to the light emitting element EL.

The third switching transistor Tr4 is basically provided to connect the drive transistor Trd to the third potential Vcc within a light emission period. In other words, the third switching transistor Tr4 turns on/off in response to the control signal DS supplied thereto from the drive scanner 5 to control the period within which the light emitting element EL emits light. As the light emission period which is included in one field increases, the screen luminance increases as much. On the contrary, if the light emission period decreases, then the screen luminance decreases. In this manner, the third switching transistor Tr4 has a principal function of controlling the ratio of the light emission period within one field to adjust the screen luminance.

As can be recognized apparently from the foregoing description, the present pixel circuit 2 is formed from five transistors Tr1 to Tr4 and Trd, one pixel capacitor Cs and one light emitting element EL. The transistors Tr1 to Tr3 and Trd are polycrystalline silicon TFTs of the N-channel type. Only the third switching transistor Tr4 is a polycrystalline silicon TFT of the P-channel type. It is to be noted, however, that the present invention is not limited to this, but TFTs of the N-channel type and the P-channel type may be used in a suitable combination or mixture. The light emitting element EL is, for example, an organic EL device of the diode type which has an anode and a cathode. However, the present invention is not limited to this, and the light emitting elements may be formed from any device which is generally driven by current to emit light.

Figure 3:
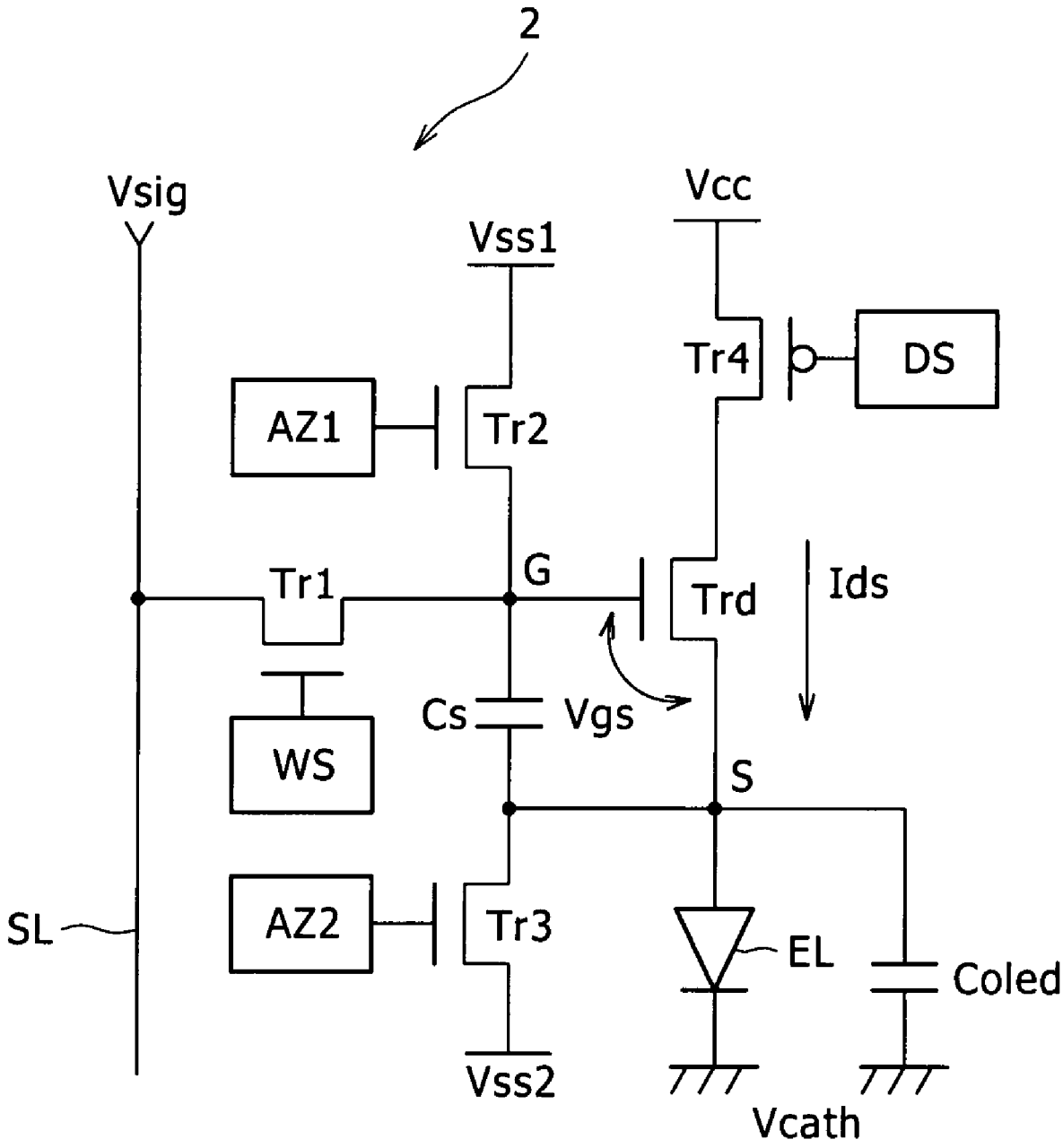
FIG. 3 is a schematic view showing a more detailed configuration of the pixel circuit shown in FIG. 2.

FIG. 3 schematically shows a portion of the image display apparatus shown in FIG. 2 which corresponds to one pixel circuit 2. In order to facilitate an understanding, a signal potential Vsig of the image signal supplied by the sampling transistor Tr1, an input voltage Vgs and output current Ids to and from the drive transistor Trd, and a capacitance component Coled which the light emitting element EL has are illustrated additionally. In the following, the operation of the pixel circuit 2 according to an embodiment of the present invention is described.

Figure 4:
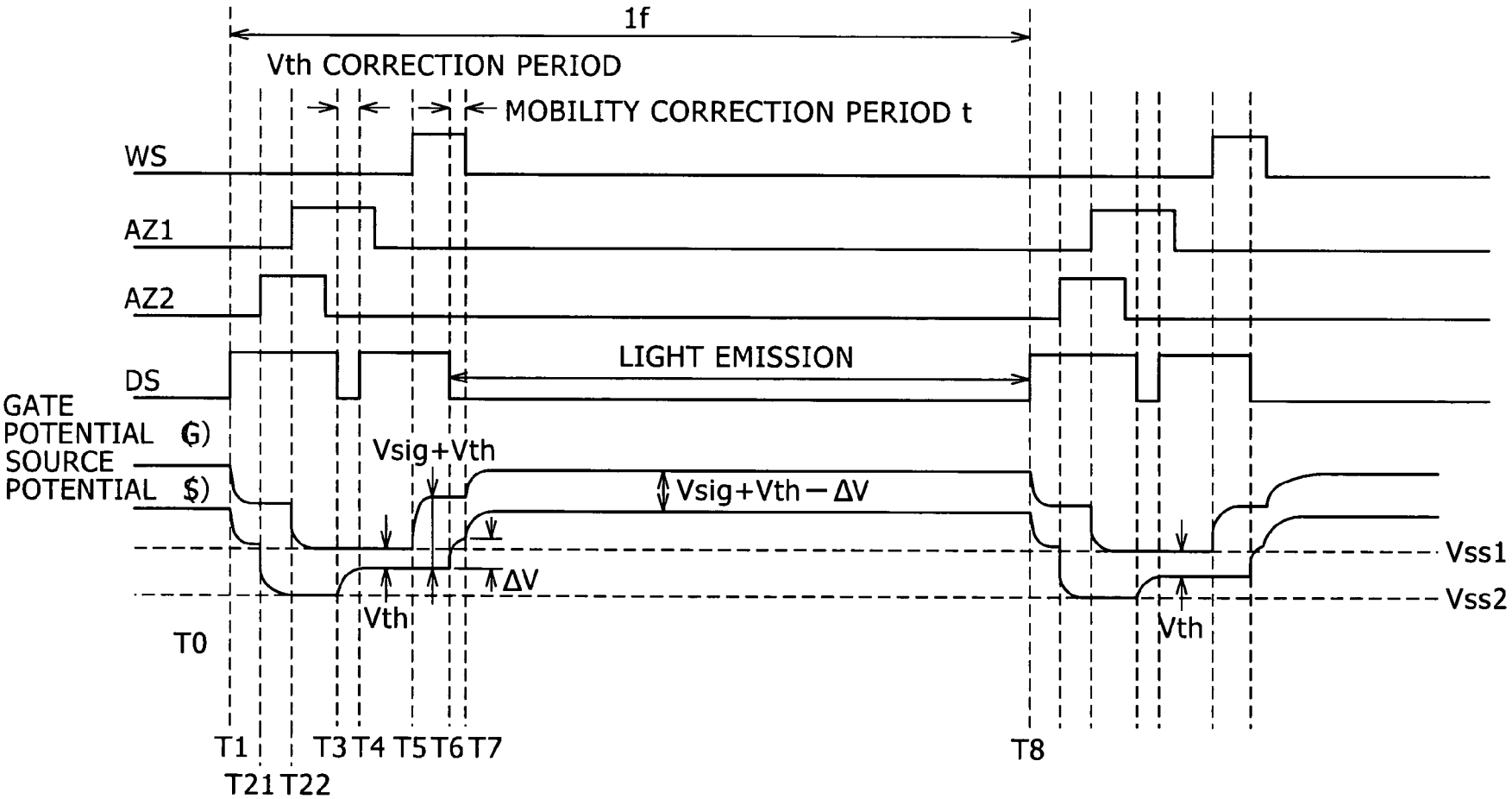
FIG. 4 is a timing chart illustrating the operation of the pixel circuit shown in FIGS. 2 and 3.

FIG. 4 illustrates the operation of the pixel circuit 2 shown in FIG. 3, and the operation of the pixel circuit 2 shown in FIG. 3 is described below particularly with reference to FIG. 4. In FIG. 4, waveforms of control signals applied to the scanning lines WS, AZ1, AZ2 and DS are illustrated along the time axis T. In order to simplify the representations, also, the control signals are denoted by like reference characters to those of the corresponding scanning lines. Since the transistors Tr1, Tr2 and Tr3 are of the N-channel type, they exhibit an on state when the scanning lines WS, AZ1 and AZ2 have the high level, but exhibit an off state when the scanning lines WS, AZ1 and AZ2 have the low level. On the other hand, since the transistor Tr4 is of the P-channel type, it exhibits an off state when the scanning line DS has the high level, but exhibits an on state when the scanning line DS has the low level. It is to be noted that the timing chart of FIG. 4 illustrates the potential variation at the gate G and the potential variation at the source S of the drive transistor Trd together with the waveforms of the control signals WS, AZ1, AZ2 and DS.

In the timing chart of FIG. 4, one field (1*f*) is defined by timings T1 to T8. The rows of the pixel array are scanned sequentially once within the period of one field. The timing chart illustrates the waveform of the control signals WS, AZ1, AZ2 and DS applied to the pixels for one row.

At a timing T0 before the field starts, all of the control signals WS, AZ1, AZ2 and DS have the low level. Accordingly, the transistors Tr1, Tr2 and Tr3 of the N-channel type exhibit an off state while only the transistor Tr4 of the P-channel type exhibits an on state. Accordingly, the drive transistor Trd is connected to the power supply Vcc through the transistor Tr4 which is in an on state. Therefore, the drive transistor Trd supplies an output current Ids to the light emitting element EL in response to the predetermined input voltage Vgs. Accordingly, the light emitting element EL emits light at the timing T0. At this time, the input voltage Vgs applied to the drive transistor Trd is represented by the difference between the gate potential (G) and the source potential (S).

At a timing T1 at which the field starts, the control signal DS changes over from the low level to the high level. Consequently, the transistor Tr4 is turned off and the drive transistor Trd is disconnected from the power supply Vcc, and as a result, the light emitting element EL stops the emission of light and enters a no-light emission period. Thus, at the timing T1, all transistors Tr1 to Tr4 are placed into an off state.

At a timing T21 after the timing T1, the control signal AZ2 rises, and the transistor Tr3 is turned on. Consequently, the source (S) of the drive transistor Trd is initialized to the predetermined potential Vss2. Then, at timing T22, the control signal AZ1 rises, and the transistor Tr2 is turned on. Consequently, the gate potential (G) of the drive transistor Trd is initialized to the potential Vss1. As a result, the gate G of the drive transistor Trd is connected to the reference potential Vss1 while the source S of the drive transistor Trd is connected to the reference potential Vss2. Here, the reference potentials Vss1 and Vss2 satisfy the expression of Vss1−Vss2>Vth, and if Vgs1−Vgs2=Vgs>Vth is satisfied, then preparations for a Vth correction, which is to be performed at a later timing T3, are made. In other words, the period between timings T21 and T3 corresponds to a reset period for the drive transistor Trd. Further, where the threshold voltage of the light emitting element EL is represented by VthEL, the reference potential Vss2 is set so as to satisfy VthEL>Vss2. Consequently, a negative bias is applied to the light emitting element EL so that the light emitting element EL is placed into a reversely biased state. This reversely biased state is requisite in order that a Vth correction operation and a mobility correction operation, which are to be performed later, may be performed normally.

At a timing T3, the control signal AZ2 is placed into the low level, and the control signal DS is placed into the low level. Consequently, the transistor Tr3 is turned off while the transistor Tr4 is turned on. As a result, an output current Ids flows into the pixel capacitor Cs, thereby to start a Vth correction operation. At this time, the gate G of the drive transistor Trd is kept at the reference potential Vss1, and consequently, the current Ids flows until after the drive transistor Trd is cut off. If the drive transistor Trd is cut off, then the source potential (S) of the drive transistor Trd becomes Vss1−Vth.

At a timing T4 after the drain current cuts off, the control signal DS is placed back into the high level, thereby to turn off the transistor Tr4. Also, the control signal AZ1 is placed back into the low level to turn off also the transistor Tr2. As a result, the threshold voltage Vth is retained fixedly in the pixel capacitor Cs. Within a later period between timings T3 and T4, the threshold voltage Vth of the drive transistor Trd is detected. The detection period between timings T3 and T4 is hereinafter referred to as the Vth correction period.

After the Vth correction is performed in such a manner as described above, the control signal WS is changed over to the high level at a timing T5, thereby to turn on the sampling transistor Tr1 to write the signal potential Vsig of the image signal into the pixel capacitor Cs. The capacitance of the pixel capacitor Cs is sufficiently low when compared with the equivalent capacitance Coled of the light emitting element EL. As a result, almost all of the signal potential Vsig of the image signal is written into the pixel capacitor Cs. More accurately, the difference Vsig−Vss1 of the signal potential Vsig from the reference potential Vss1 is written into the pixel capacitor Cs. Accordingly, the input voltage Vgs between the gate G and the source S of the drive transistor Trd has the level (Vsig−Vss1+Vth) which is the sum of the threshold voltage Vth detected and retained formerly and the difference Vsig−Vss1 sampled in the present operation cycle. If it is assumed that the reference potential Vss1 is Vss1=0 V in order to simplify the following description, then the gate/source voltage Vgs is given by Vsig+Vth, as seen in the timing chart of FIG. 4. Such sampling of the signal potential Vsig of the image signal is performed until a timing T7 at which the control signal WS returns to the low level. In other words, the sampling period is given by a period between timings T5 and T7.

At a timing T6 before the timing T7 at which the sampling period ends, the control signal DS changes to the low level, thereby to turn on the transistor Tr4. Consequently, the drive transistor Trd is connected to the power supply Vcc so that the pixel circuit 2 advances from the non-light emission period to a light emission period. Within the period between timings T6 and T7, within which the sampling transistor Tr1 remains in an on state and the transistor Tr4 is in an on state in this manner, a mobility correction of the drive transistor Trd is performed. In particular, in the present invention, the mobility correction is performed within the period between timings T6 and T7, within which a rear portion of the sampling period and a front portion of the light emission period overlap with each other. It is to be noted that, at the beginning of the light emission period at which the mobility correction is performed, the light emitting element EL actually is in a reversed biased state and therefore does not emit light. Within the mobility correction period between timings T6 and T7, the output current Ids flows through the drive transistor Trd in a state wherein the gate G of the drive transistor Trd is fixed to the level of the signal potential Vsig of the image signal. Here, if the potential Vss1, the threshold voltage Vth and the threshold voltage VthEL are set so as to satisfy Vss1−Vth<VthEL, then the light emitting element EL is placed into the reversely biased state, and therefore, the light emitting element EL exhibits characteristic and not a diode characteristic a simple capacitor. Therefore, the output current Ids flowing through the drive transistor Trd is written into the capacitor C=Cs+Coled, which is a combination of the pixel capacitor Cs and the equivalent capacitance Coled of the light emitting element EL. As a result, the source potential (S) of the drive transistor Trd gradually rises.

In the timing chart of FIG. 4, the rise amount is represented by ΔV. Since the rise amount ΔV is subtracted from the gate/source voltage Vgs retained in the pixel capacitor Cs, this is equivalent to application of a negative feedback. The mobility μ can be corrected by negatively feeding back the output current Ids of the drive transistor Trd to the input voltage Vgs of the drive transistor Trd in this manner. It is to be noted that the negative feedback amount ΔV can be optimized by adjusting the time width t of the mobility correction period between timings T6 and T7. To this end, the falling edge of the control signal WS is provided with a gradient.

At a timing T7, the control signal WS changes over to the low level, thereby to turn off the sampling transistor Tr1. As a result, the gate G of the drive transistor Trd is disconnected from the signal line SL. Since the application of the signal potential Vsig of the image signal is canceled, the gate potential (G) of the drive transistor Trd is permitted to rise, and gradually rises together with the source potential (S). In the meantime, the gate/source voltage Vgs retained in the pixel capacitor Cs keeps the value of Vsig−LV+Vth. As the source potential (S) rises, the reversely biased state of the light emitting element EL is canceled soon, and consequently, the light emitting element EL starts actual light emission as the output current Ids is supplied thereto. The relationship between the drain current Ids and the gate voltage Vgs in this instance is represented by the following transistor characteristic expression (1):

$$Ids=(1/2)\mu(W/L)Cox(Vgs-Vth)2 \quad (1)$$

where Vgs is the gate voltage applied to the gate with reference to the source, Vth the threshold voltage of the transistor, μ the mobility of the semiconductor thin film of the channel of the transistor, W the channel width, L the channel length, and Cox the gate capacitance.

The following expression (2) is obtained by substituting Vsig−ΔV+Vth into Vgs of the transistor characteristic expression (1):

$$Ids=k\mu(Vgs-Vth)2=k\mu(Vsig-\Delta V)2 \quad (2)$$

where k=(½)(W/L)Cox.

In the characteristic expression (2), the term of Vth is canceled, and it can be recognized that the output current Ids supplied to the light emitting element EL does not rely upon the threshold voltage Vth of the drive transistor Trd. Basically, the drain current Ids depends upon the signal potential Vsig of the image signal. In other words, the light emitting element EL emits light with a luminance corresponding to the signal potential Vsig of the image signal. Thereupon, the signal potential Vsig is in a state corrected with the negative feedback amount LV. The correction amount ΔV acts so as to cancel the effect of the mobility μ which is positioned just at the coefficient part of the characteristic expression (2). Accordingly, the drain current Ids substantially relies only on the signal potential Vsig of the image signal.

Finally at a timing T8, the scanning line DS changes over to the high level, thereby to turn off the transistor Tr4. Consequently, the light emission ends and the field ends. Thereafter, a next field is entered, and the Vth correction operation, the signal potential sampling operation, the mobility correction operation and the light emitting operation are repeated for the next field.

Figure 5:
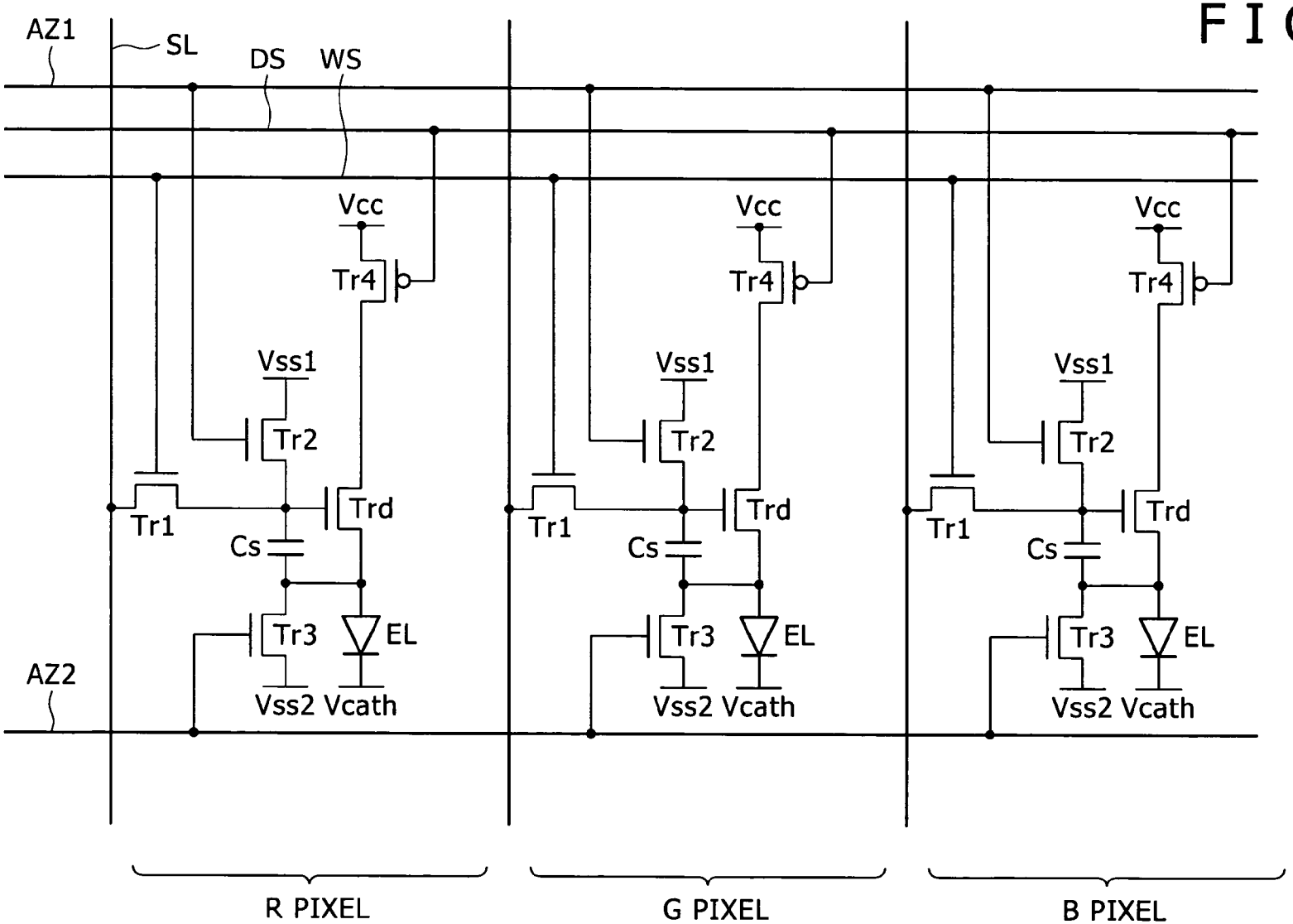
FIG. 5 is a circuit diagram showing a pixel trio formed from three R, G and B pixels each including the pixel circuit shown in FIG. 2.

FIG. 5 shows a pixel trio wherein three pixels of a R pixel, a G pixel and a B pixel are juxtaposed. In the circuit configuration to which the present invention is applied, each of the R, G and B pixels forms an independent pixel circuit, and the R, G and B pixels have the same circuit configuration. In particular, referring to FIG. 5, the pixel circuit of each of the R, G and B pixels includes transistors Tr1 to Tr4 and Trd, a pixel capacitor (retaining capacitor) Cs and a light emitting element EL. The light emitting element EL emits light of a color allocated to each of the R, G and B pixels.

Also, the switching transistor Tr4 for controlling the light emission period of a pixel is provided in each pixel. The switching transistor Tr4 is turned on in response to the control signal DS supplied thereto from the scanning line DS. In the circuit configuration on which the resent invention is based, a transistor Tr4 is disposed for each of the R, G and B pixels of the pixel trio. For example, in the case of a panel which includes 480 pixel trios in the horizontal direction and 320 pixel trios in the vertical reaction, 480×320×3=460,800 switching transistors Tr4 are requisite. In this manner, the total number of elements in the entire panel is very great. Also, a number of power supply lines Vcc equal to the number of switching transistors Tr4 juxtaposed in the horizontal direction are requisite. Therefore, where the number of elements is great, there are the problems that deterioration of the panel yield is invited, achievement of high definition of a screen is difficult and a high production cost is requisite.

Figure 6:
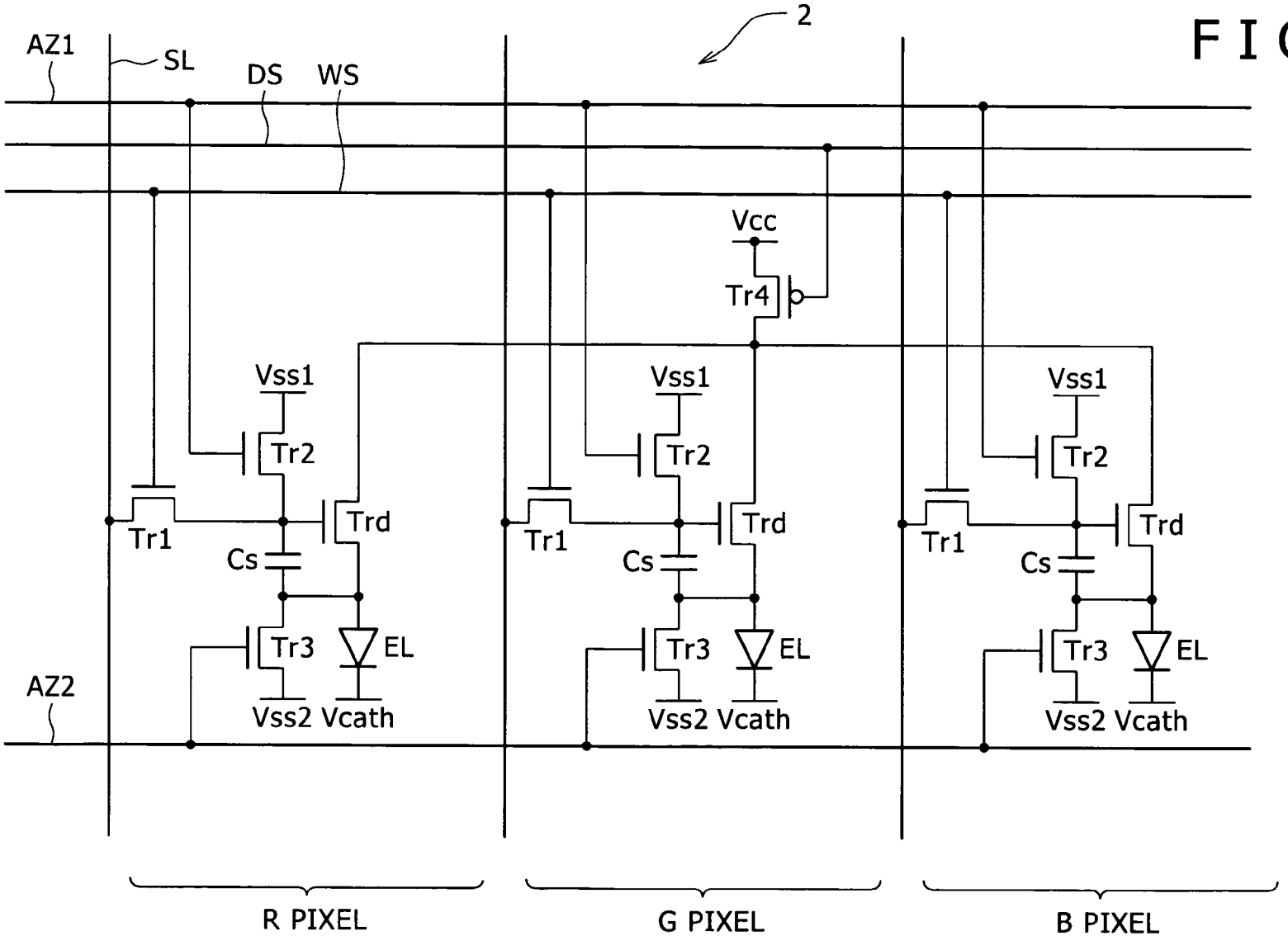
FIG. 6 is a circuit diagram showing a pixel circuit according to another embodiment of the present invention.

FIG. 6 schematically shows a pixel circuit according to an embodiment of the present invention. Referring to FIG. 6, the pixel circuit 2 shown includes three R, G and B pixels to which the three primary colors of R, G and B are allocated, respectively, and a power supply line Vcc. It is to be noted that, while the pixel circuit 2 shown in FIGS. 2 and 3 is for one pixel, the pixel circuit 2 shown in FIG. 6 is for three pixels, that is, R, G and B pixels. Each of the R, G and B pixels includes a sampling transistor Tr1 for sampling the image signal, a retaining capacitor (pixel capacitor) Cs for retaining the sampled image signal, a drive transistor Trd for outputting drive current corresponding to the retained image signal within a predetermined light emission period, and a light emitting element EL for emitting light of a color allocated thereto in response to the drive current. As a characteristic configuration, the pixel circuit 2 includes one switching transistor Tr4 disposed commonly to the three R, G and B pixels in order to connect the drive transistors Trd of the R, G and B pixels to the power supply line Vcc within a light emission period. In other words, while three switching transistors Tr4 are disposed individually in the R, G and B pixels in the reference example shown in FIG. 5, the pixel circuit according to an embodiment of the present invention includes a single switching transistor Tr4 common to the R, G and B pixels.

By the configuration just described, the total number of switching transistors Tr4 is reduced to one third that of the reference example shown in FIG. 5, and consequently, a reduction in cost can be anticipated. Further, since two transistor Tr4 and two power supply lines Vcc are reduced per one pixel trio, the layout within each pixel is provided with a margin, and consequently, an inadvertent short-circuiting can be prevented. In addition, since one switching transistor Tr4 is used commonly for R, G and B pixels, also, it is possible to suppress the dispersion in luminance among the R, G and B pixels.

While the switching transistor Tr4 principally defines the light emission period as described hereinabove, it also controls the mobility correction period. As described hereinabove, the mobility correction period of the drive transistor Trd starts when the transistor Tr4 turns on, and ends when the sampling transistor Tr1 turns off. The switching transistor Tr4 defines the starting timing of the mobility correction period. By disposing the switching transistor Tr4 commonly to the R, G and B pixels, the mobility correction period of the R, G and B pixels can be made common among the pixels. Consequently, the dispersion in luminance among the R, G and B pixels can be suppressed. Further, since also the influence of gate coupling of the switching transistor Tr4 and so forth become common to the three R, G and B pixels, no dispersion appears with the luminance and the uniformity of the luminance can be assured.

Figure 7:
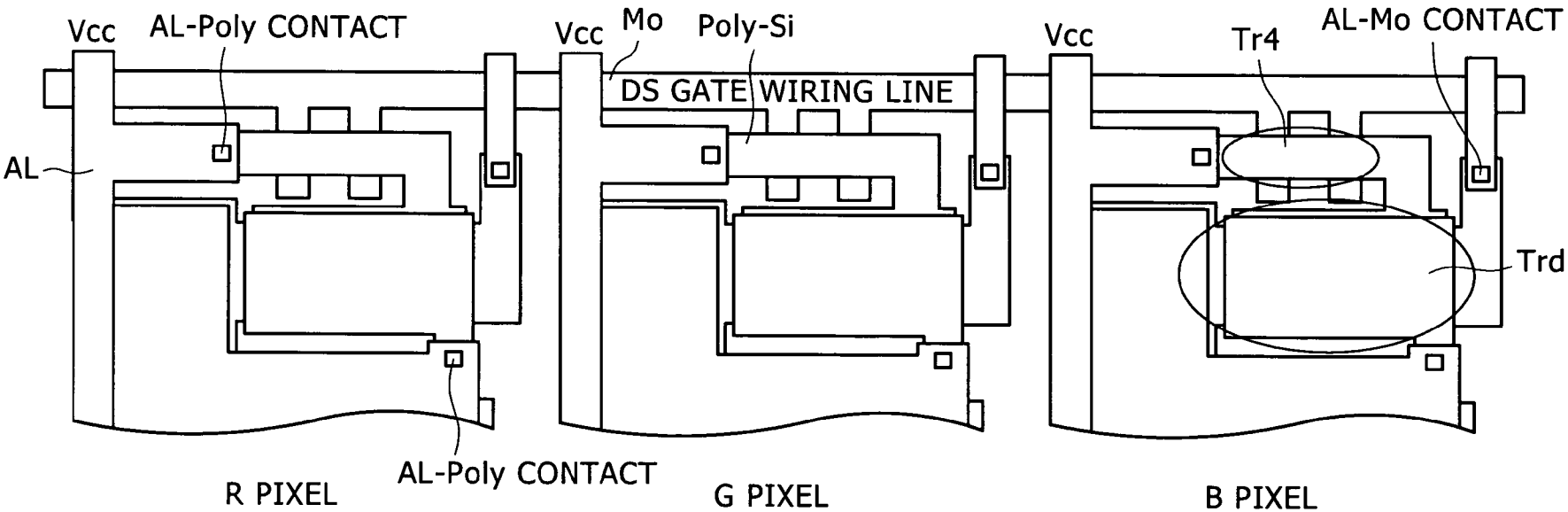
FIG. 7 is a schematic view showing an example of a pattern layout of the pixel circuit of FIG. 5 for reference.

FIG. 7 shows a wiring line pattern of a RGB pixel trio which corresponds to the reference example shown in FIG. 5. As described hereinabove, in the reference example of FIG. 5, a drive transistor Trd and a switching transistor Tr4 are formed in each of R, G and B pixels. Therefore, it is necessary to provide a power supply line Vcc for each of the R, G and B pixels. In the example shown in FIG. 7, the gates of the drive transistor Trd and the switching transistor Tr4 are formed first. Upon formation of the gates, also, gate wiring of the scanning lines DS is performed. It is to be noted that the gates of the transistors Trd and Tr4 and the DS gate wiring line are formed from molybdenum (Mo) metal. On the gates and the DS gate wiring lines, a Poly-Si layer which forms element regions for the drive transistor Trd and the switching transistor Tr4 is formed. Further, on the Poly-Si layer, wiring lines for appropriately connecting the source and drain of the drive transistor Trd and the switching transistor Tr4 are formed from aluminum (Al). Thereupon, also, the power supply lines Vcc are formed from aluminum wiring lines simultaneously.

Figure 8:
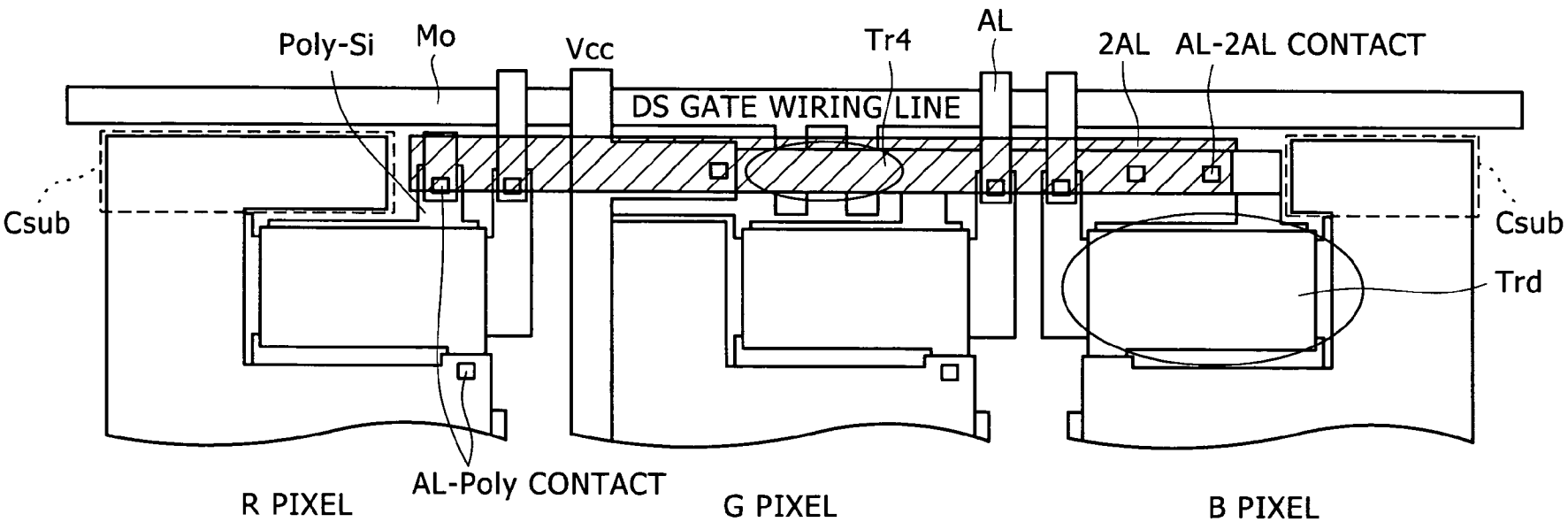
FIG. 8 is a schematic view showing a pattern layout of the pixel circuit of FIG. 6.

FIG. 8 shows a pattern layout of the pixel circuit according to an embodiment of the present invention. As described hereinabove, in the pixel circuit 2 according to an embodiment of the present invention, a switching transistor Tr4 is disposed commonly to R, G and B pixels. In the example shown in FIG. 8, the transistor Tr4 is formed only on the G pixel. For example, a supplementary capacitor Csub for supplementing the regaining capacitor (pixel capacitor) Cs can be provided at a portion of the R pixel from which the transistor Tr4 is eliminated. Similarly, as occasion demands, a supplementary capacitor Csub can be formed at a portion of the B pixel from which the transistor Tr4 is eliminated.

The source of the switching transistor Tr4 formed on the G pixel is connected to a power supply line Vcc. Meanwhile, the drain of the switching transistor Tr4 is connected to the drive transistor Trd of the G pixel and also to the drive transistor Trd of the B pixel formed on the right side of the G pixel. For such a connection, the drain region of the switching transistor Tr4 is extended as it is so as to be used as a wiring line for the connection. Meanwhile, to the drive transistor Trd of the R pixel positioned on the left side of the G pixel, an aluminum wiring line of a second layer (2Al) formed on the aluminum wiring line of a first layer (Al) so as to form a multi-layer film is connected through the aluminum wiring line of the first layer (Al). Where the switching transistor Tr4 is used commonly in this manner, it has to extend across a wiring line such as the VCC power supply line. To this end, wiring lines are formed in multi-layers, and the additionally provided second layer (2Al) is used to connect the drain of the switching transistor Tr4 to the drive transistor Trd of the R pixel. In the multilayer configuration in the present embodiment, aluminum is used for the second layer wiring lines. For the process in this instance, a general TFT process can be used. As occasion demands, silver metal can be used for the wiring lines of the additionally provided second layer. In this instance, a process of forming the anode of the light emitting element EL can be utilized to form the second wiring line layer. In this manner, the second wiring line layer can be added without applying a great variation to an existing process in this instance.

Figure 9:
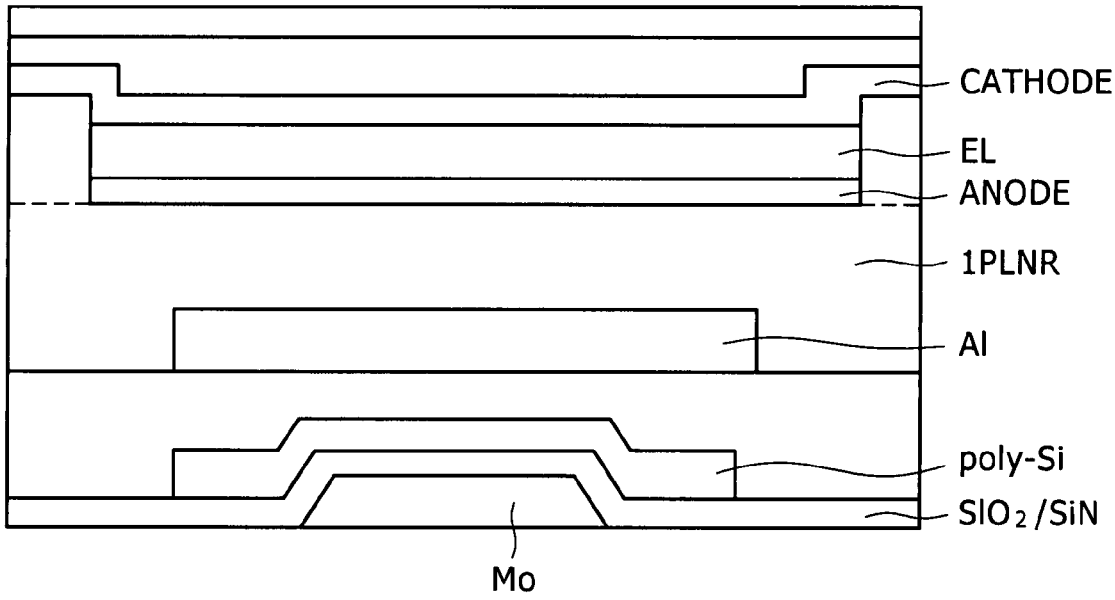
FIG. 9 is a schematic view showing a sectional configuration of the pixel circuit of FIGS. 5 and 7.

FIG. 9 schematically illustrates a process used commonly in fabrication of the pixels shown in FIGS. 5 and 7. According to the commonly used process, gate electrodes and gate wiring lines (scanning lines) of transistors are formed from metal Mo on a substrate (not shown) of glass or the like. Then, the gate electrodes and the gate wiring lines are covered with a two-layer gate insulating film $SiO_2$/SiN. A polycrystalline silicon thin film poly-Si from which element regions of transistors are to be formed is formed on the two-layer gate insulating film $SiO_2$/SiN by patterning. The polycrystalline silicon thin film poly-Si is covered with an interlayer insulating film, and wiring lines of the first layer are formed from Al metal on the interlayer insulating film by patterning. The metal wiring lines are used as signal lines and power supply lines Vcc. The wiring lines are covered with a first interlayer insulating film 1PLNR, and anode electrodes ANODE for the light emitting elements EL are formed by vapor deposition or the like on the first interlayer insulating film 1PLNR. Further, an organic EL material from which a light emitting layer is to be formed is vapor deposited on the anode electrodes ANODE, and then cathode electrodes CATHODE are formed. Further, an insulating film and a protective film are formed on the cathode electrodes CATHODE.

Figure 10:
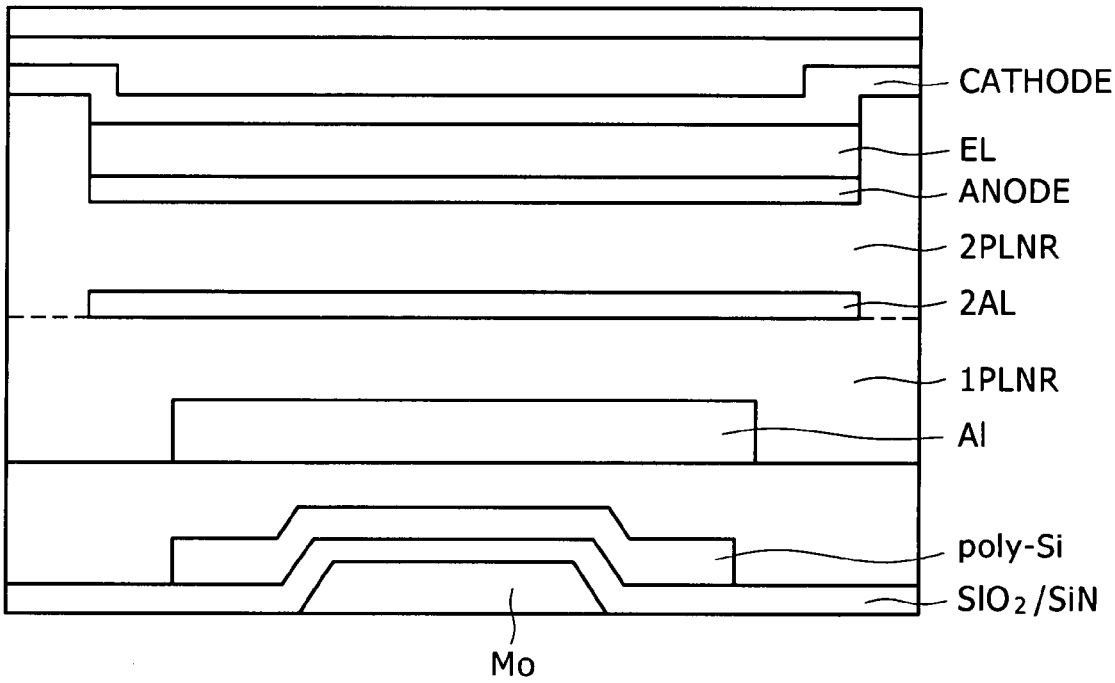
FIG. 10 is a schematic view showing a sectional structure of the pixel circuit of FIGS. 6 and 8.

FIG. 10 schematically illustrates a process for fabrication of the pixel circuit shown in FIGS. 6 and 8 which includes multi-layer wiring lines. Basically, the commonly used process described hereinabove with reference to FIG. 9 is applied to the present fabrication process. As seen in FIG. 10; signal lines and power supply lines Vcc are first formed from metal Al of the first layer and then covered with an interlayer insulating film 1PLNR of the first layer. Further, metal wiring lines (2Al) of the second layer are formed, for example, from aluminum metal on the interlayer insulating film 1PLNR of the first layer. The second wiring lines (2Al) of the second layer can be formed using a process the same as the process used for the formation of the aluminum wiring lines of the first layer. The aluminum wiring lines 2Al of the second layer are covered with a second interlayer insulating film 2PLNR, and anode electrodes ANODE of light emitting elements EL are formed, for example, by vapor deposition of Ag or the like on the second interlayer insulating film 2PLNR. As occasion demands, the metal wiring lines of the second layer may be formed not from aluminum but from silver. In this instance, the metal wiring lines of the second layer are formed using a fabrication process of the anode electrodes of the light emitting elements EL.

Figure 11:
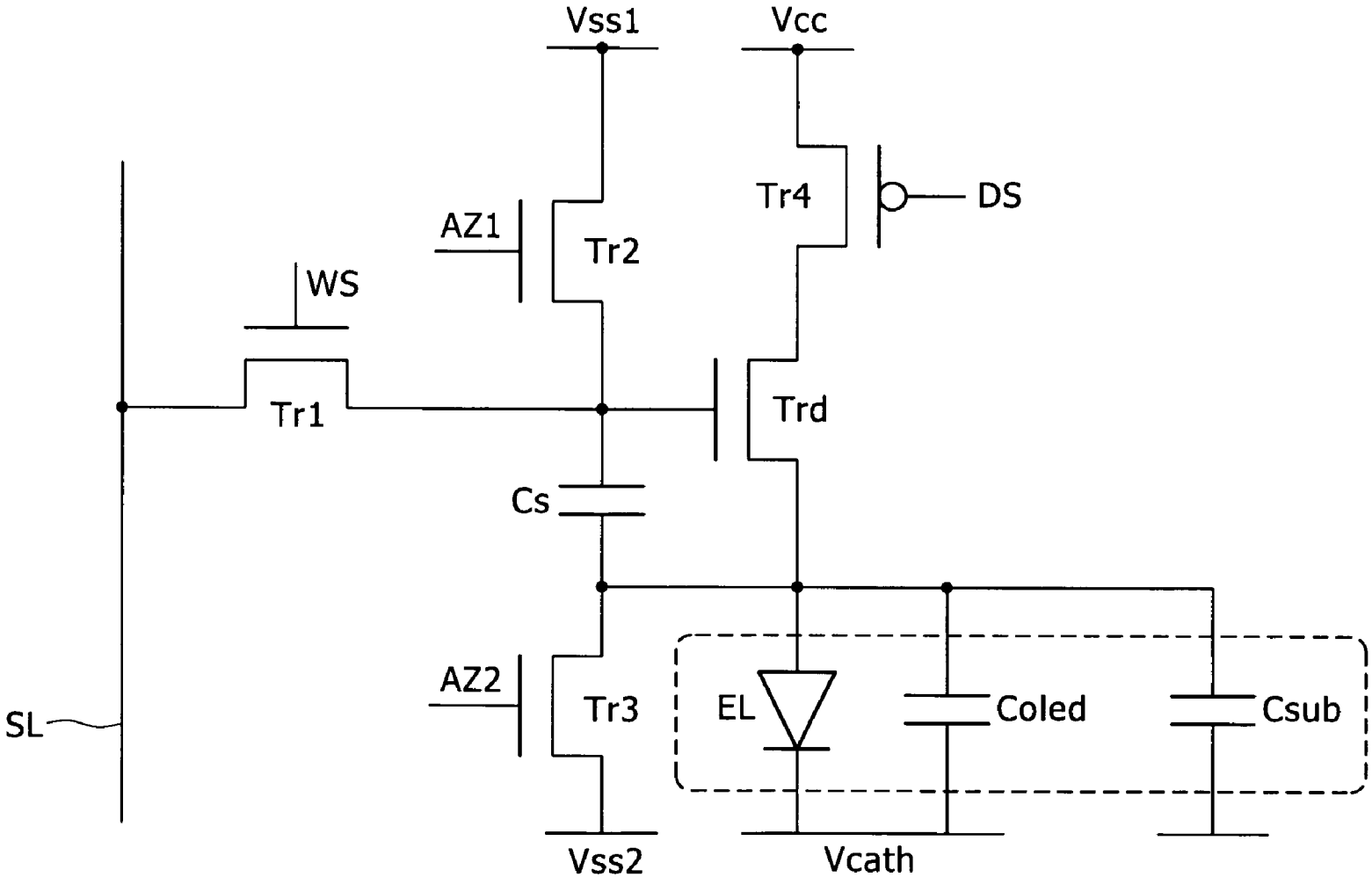
FIG. 11 is a schematic view showing another example of a pixel circuit for reference.

FIG. 11 shows a modification to the pixel circuit shown in FIGS. 2 and 5. Referring to FIG. 11, the modified pixel circuit shown includes a supplementary capacitor Csub formed in parallel to the equivalent capacitance Coled of the light emitting element EL. The supplementary capacitor Csub is connected in parallel to the equivalent capacitance Coled when an input gain is to be assured when an image signal is written into the pixel capacitor Cs.

Figure 12:
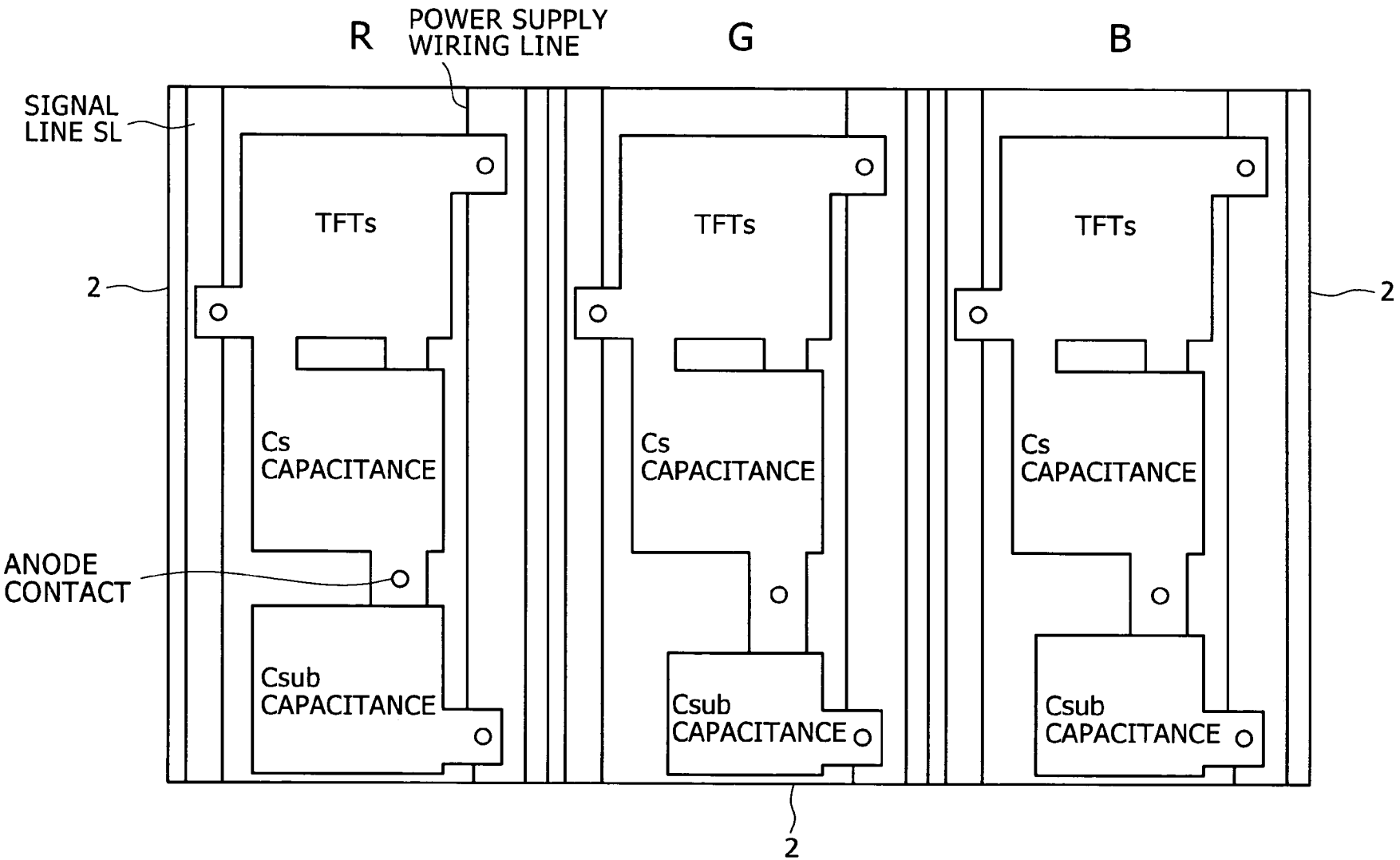
FIG. 12 is a schematic top plan view showing a capacitor layout of a modification to the pattern layout of the pixel circuit shown in FIG. 8.

FIG. 12 shows a schematic pattern layout of a pixel trio wherein a supplementary capacitor Csub is formed in addition to a pixel capacitor Cs. The pixel circuits 2 for the R, G and B colors include a red light emitting element, a green light emitting element and a blue light emitting element, respectively. The supplementary capacitors Csub formed in the pixel circuits 2 have capacitance values different among the different light emitting elements, thereby to adjust the white balance among the pixel circuits for R, G and B. In this instance, it is appropriate in terms of the layout to dispose the switching transistor Tr4, which is used commonly by the R, G and B pixels, in a pixel which includes a supplementary capacitor Csub which has the lowest capacitance value. In the example of FIG. 12, since the capacitance value of the supplementary capacitor Csub of the G pixel is lowest, the G pixel has a room in space. By forming the switching transistor Tr4 at the portion corresponding to the room, the mounting efficiency can be improved. On the other hand, since the switching transistor Tr4 is used commonly, a space is provided in both the R pixel and the B pixel. Those portions may be utilized as a space for the supplementary capacitor Csub, as seen in FIG. 7.

The sampling transistor Tr1, the drive transistor Trd and switching transistors are each formed from a thin film transistor TFTs formed on an insulating substrate, and the pixel capacitor Cs and the supplementary capacitor Csub are each formed from a thin film capacitance element formed on the insulating substrate. In the example shown in FIG. 12, one of terminals of the supplementary capacitor Csub is connected to the pixel capacitor Cs through an anode contact while the other terminal is connected to a predetermined fixed potential. The fixed potential may be the ground potential Vcath on the cathode side of the light emitting element EL. The pixel circuits 2 shown in FIG. 12 have a lamination structure, and the thin film transistors TFTs, the pixel capacitors Cs, the supplementary capacitors Csub and so forth are formed on the lower layer. The light emitting elements EL are connected to the upper layer. In order to facilitate understanding, the light emitting elements EL of the upper layer are omitted in FIG. 12. Actually, the light emitting elements EL are connected to the pixel circuits 2 through an anode contact.

Figure 13:
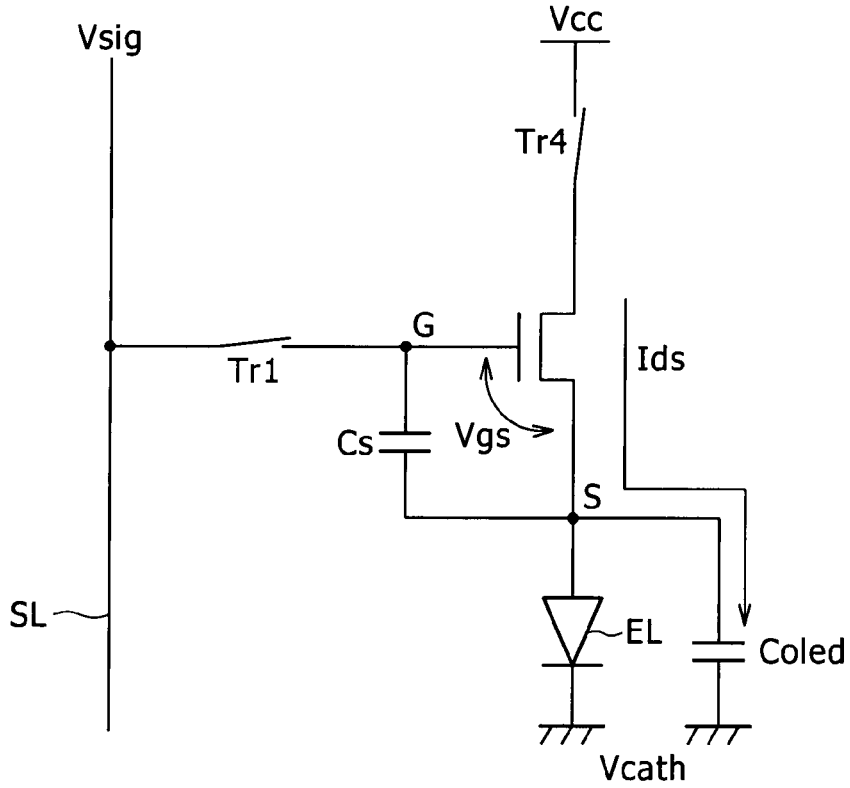
FIG. 13 is a diagrammatic view illustrating operation of the pixel circuit of FIG. 6.

Finally, a mobility correction operation of the pixel circuit according to an embodiment of the present invention is described supplementarily for the reference. FIG. 13 illustrates a state of the pixel circuit 2 within the mobility correction period between timings T6 and T7. Referring to FIG. 13, within the mobility correction period between timings T6 and T7, the sampling transistor Tr1 and the switching transistor Tr4 exhibit an on state while the remaining switching transistors Tr2 and Tr3 exhibit an off state. In this state, the source potential (S) of the switching transistor Tr4 is given by Vss1−Vth. This source potential "S" is the anode potential of the light emitting element EL as well. As described hereinabove, where the potential Vss1, the threshold voltage Vth and the threshold voltage VthEL are set so as to satisfy Vss1−Vth<VthEL, the light emitting element EL is placed into a reversely biased state and exhibits a simple capacitor characteristic and not a diode characteristic. Therefore, the output current Ids which flows into the drive transistor Trd flows into the combined capacitor C=Cs+Coled of the pixel capacitor Cs and the equivalent capacitance Coled of the light emitting element EL. In other words, part of the drain current Ids is fed back negatively to the pixel capacitor Cs to perform a correction of the mobility.

Figure 14:
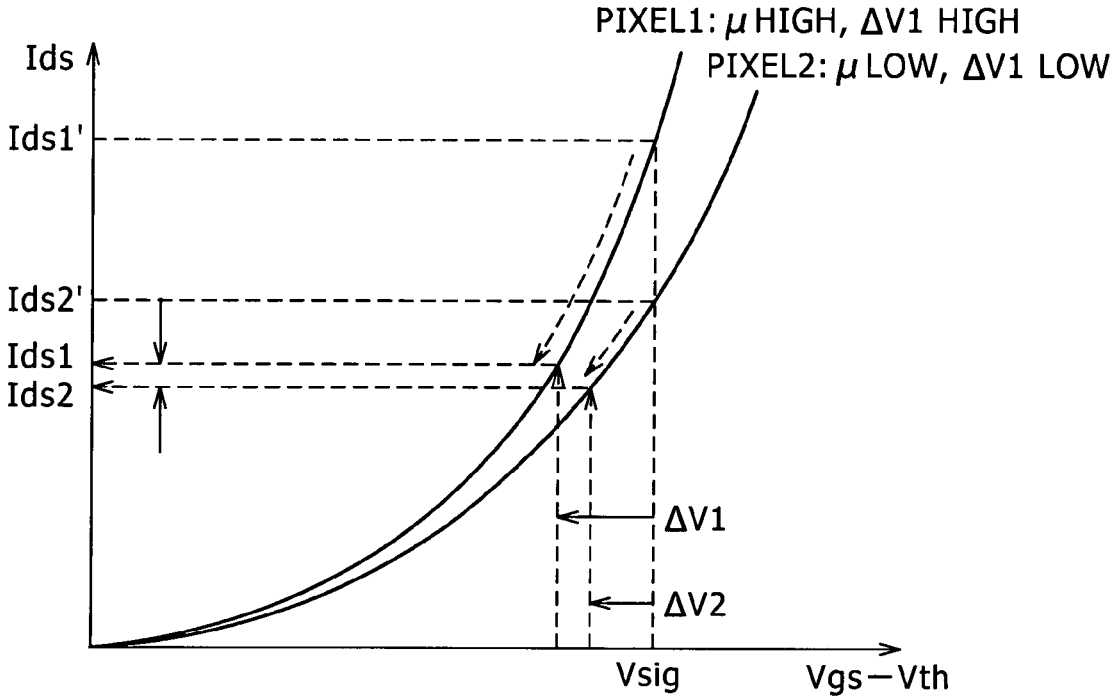
FIG. 14 is a graph illustrating the operation of the pixel circuit FIG. 6.

FIG. 14 illustrates the transistor characteristic expression (2) given hereinabove, and the axis of ordinate is the output current Ids and the axis of abscissa is the signal potential Vsig. Also, the characteristic expression (2) is indicated below the graph. The graph of FIG. 14 includes characteristic curves regarding a pixel 1 and another pixel 2 for comparison. The mobility μ of the drive transistor of the pixel 1 is relatively high. On the contrary, the mobility p of the drive transistor included in the pixel 2 is relatively low. Where the drive transistors are formed from a polycrystalline silicon thin film transistor or the like in this manner, the mobility μ may not be prevented from dispersing among pixels. For example, if the signal potentials Vsig of an image signal having an equal level are written into the pixels 1 and 2, then if some mobility correction is not performed, the output current Ids1' flowing to the pixel 1 having the high mobility μ exhibits a great difference from the output current Ids2' which flows to the pixel 2 having the low mobility μ. Since a great difference is caused in the output current Ids by a dispersion of the mobility μ in this manner, irregular stripes appear and damage the uniformity of the screen image.

Therefore, according to an embodiment of the present invention, output current is negatively fed back to the input voltage side, thereby to cancel the dispersion in mobility. As can be seen apparently from the transistor characteristic expression (1), as the mobility increases, the drain current Ids increases. Accordingly, the negative feedback amount ΔV increases as the mobility μ increases. As seen in FIG. 14, the negative feedback amount ΔV1 of the pixel 1 having a higher mobility μ is greater than the negative feedback amount ΔV2 of the pixel 2 having a lower mobility μ. Accordingly, as the mobility μ increases, the negative feedback amount increases and the dispersion can be suppressed by a greater amount. As seen in FIG. 14, if the correction of the negative feedback amount ΔV1 is applied to the pixel 1 having a higher mobility μ, then the output current drops by a great amount from Ids1' to Ids1. On the other hand, since the correction amount ΔV2 of the pixel 2 having a lower mobility μ is small, the output current Ids2' does not decrease by a great amount to Ids2. As a result, the output current Ids1 and the output current Ids2 become substantially equal to each other, and the dispersion in mobility is canceled. Since the cancellation of the dispersion in mobility is performed over the overall range of the signal potential Vsig from the black level to the white level, the uniformity of the screen image becomes very high. In summary, where pixels 1 and 2 which are different in mobility from each other are involved, the correction amount ΔV1 of the pixel 1 having a higher mobility is smaller than the correction amount ΔV2 of the pixel 2 having a lower mobility. In other words, as the mobility increases, the correction amount ΔV increases and the value of decrease of the output current Ids increases. Consequently, the current values of the pixels which are different in mobility from one another are made uniform, and the dispersion in mobility can be corrected.

In the following, a numerical analysis of the mobility correction described above is described for reference. The analysis is performed by taking the source potential of the drive transistor Trd as a variable V in a state wherein the transistors Tr1 to Tr4 are in an on state as seen in FIG. 13. Where the source potential (S) of the drive transistor Trd is represented by V, the drain current Ids flowing through the drive transistor Trd is given by the following expression (3):

$$I_{ds}=k\mu(V_{gs}-V_{th})^2=k\mu(V_{sig}-V-V_{th})^2 \tag{3}$$

Further, from a relationship between the drain current Ids and the capacitance C (=Cs+Coled), Ids=dQ/dt=CdV/dt is satisfied as indicated by the following expression (4):

from the equation $$I_{ds}=\frac{dQ}{dt}=C\frac{dV}{dt},.$$

$$\int\frac{1}{C}dt= \tag{4}$$

$$\int\frac{1}{I_{ds}}dV \Leftrightarrow \int_0^t\frac{1}{C}dt=\int_{-Vth}^{V}\frac{1}{k\mu(V_{sig}-V_{th}-V)^2}dV \Leftrightarrow \frac{k\mu}{C}t=$$

$$\left[\frac{1}{V_{sig}-V_{th}-V}\right]_{-Vth}^{V}=\frac{1}{V_{sig}-V_{th}-V}-\frac{1}{V_{sig}} \Leftrightarrow V_{sig}-V_{th}-V=$$

$$\frac{1}{\frac{1}{V_{sig}}+\frac{k\mu}{C}t}=\frac{V_{sig}}{1+V_{sig}\frac{k\mu}{C}t}$$

The expression (3) is substituted into the expression (4), and then the opposite sides are differentiated. Here, the initial state of the variable V is −Vth, and the mobility dispersion correction period (T6 to T7) is represented by t. By solving the differential equation, the pixel current with respect to the correction time t is given by the following expression (5):

$$I_{dx}=k\mu\left(\frac{V_{sig}}{1+V_{sig}\frac{k\mu}{C}t}\right)^2 \tag{5}$$

The display apparatus according to an embodiment of the present invention described above can be applied as a display apparatus of such various electric apparatuses as shown in FIGS. 15A to 15G. In particular, the display apparatus can be applied to various electronic apparatuses in various fields wherein an image signal inputted to or produced in the electronic apparatus is displayed as an image or a video, such as digital cameras, laptop type personal computers, portable telephone sets and video cameras.

Figure 16:
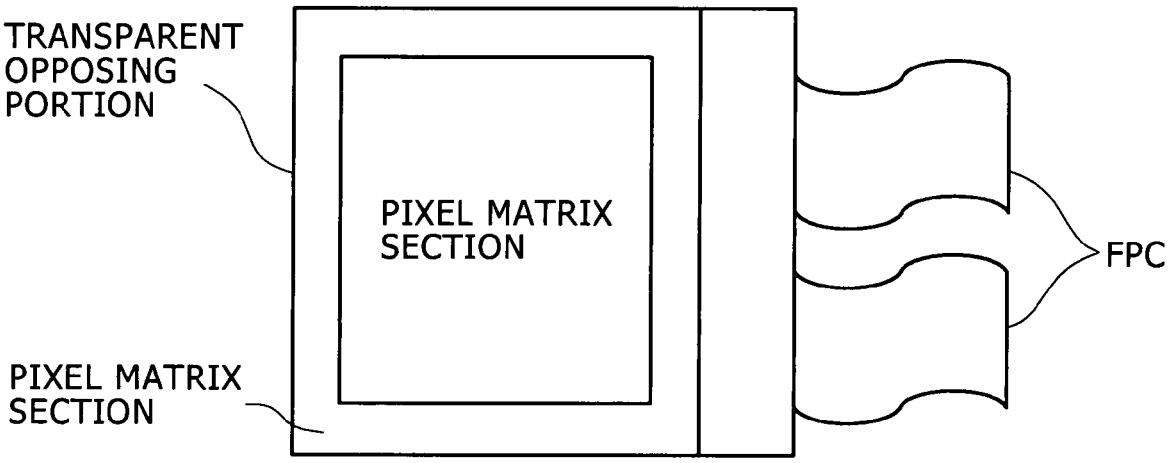
FIG. 16 is a schematic diagrammatic view of a device.

It is to be noted that the display apparatus according to an embodiment of the present invention may be formed as an apparatus of a module type as shown in FIG. 16. For example, the display apparatus in this instance may be a display module wherein the pixel array section is adhered to an opposing portion of a glass plate. A color filter, a protective film, a light intercepting film or the like may be provided on the transparent opposing portion. It is to be noted that the display module may include a flexible printed circuit (FPC) for inputting and outputting signals and so forth from the outside to the pixel array section and vice versa.

In the following, examples of the electronic apparatus to which the display apparatus is applied are described.

Figure 15A:
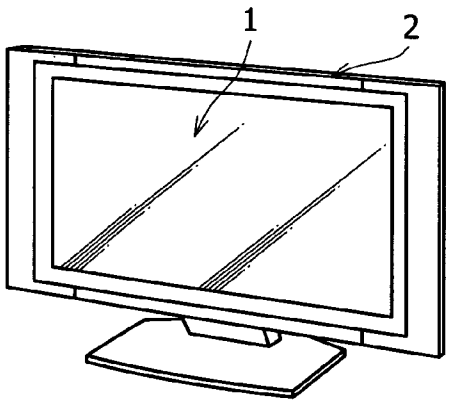
FIGS. 15A to 15G are schematic views showing examples of an electronic equipment.

FIG. 15A shows a television receiver to which the present invention is applied. Referring to FIG. 15A, the television receiver includes an image display screen 1 formed from a front panel 2 and is produced using the display apparatus of the present invention as the image display screen 1.

Figure 15B:
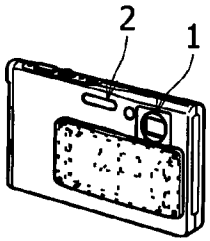
Figure 15C:
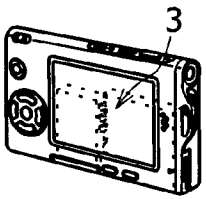

FIGS. 15B and 15C show a digital camera to which the present invention is applied. Referring to FIGS. 15B and 15C, the digital camera shown includes an image pickup lens 1, a flash light emitting section 2 and a display section 3. The digital camera is produced using the display apparatus of the present invention as the display section 3.

Figure 15D:
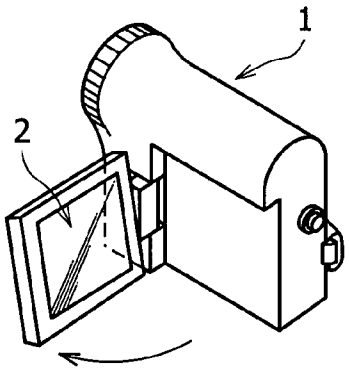

FIG. 15D shows a video camera to which the present invention is applied. Referring to FIG. 15D, the video camera shown includes a body section 1 and a display section 2 and is produced using the display apparatus of the present invention as the display section 2.

Figure 15E:
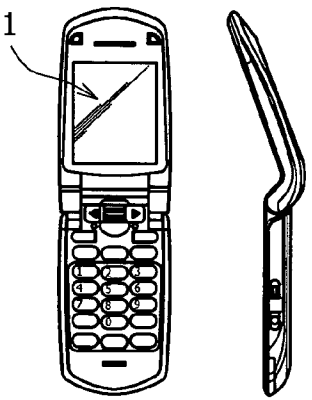
Figure 15F:
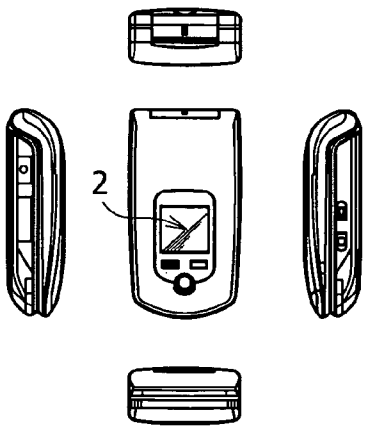

FIGS. 15E and 15F show a portable terminal apparatus to which the present invention is applied. Referring to FIGS. 15E and 15F, the portable terminal apparatus includes a display section 1 and a subdisplay section 2. The portable terminal apparatus is produced using the display apparatus of the present invention as the display apparatus 1 or the subdisplay section 2.

Figure 15G:
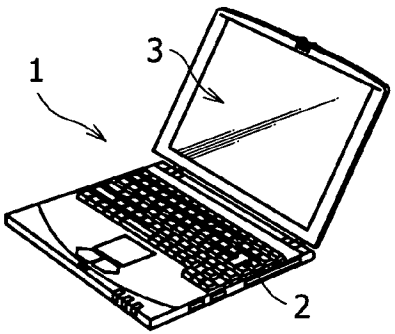

FIG. 15G shows a laptop type personal computer to which the present invention is applied. Referring to FIG. 15G, the laptop type personal computer shown includes a body 1, a keyboard 2 that is to be operated in order to input characters and so forth and a display section 3 for displaying an image. The laptop type personal computer is produced using the display apparatus of the present invention as the display section 3.

While a preferred embodiment of the present invention has been described using specific terms, such description is for illustrative purpose only, and it is to be understood that changes and variations may be made without departing from the spirit or scope of the following claims.

What is claimed is:

1. A pixel circuit, comprising:

three pixels to which three primary colors are allocated;

a power supply line;

wherein each of said three pixels includes a sampling transistor configured to sample an image signal, a retaining capacitor configured to retain the sampled image signal, a drive transistor configured to output drive current corresponding to the retained image signal within a predetermined light emission period, and a light emitting element configured to emit light in the color allocated to said three pixels in response to the drive current, and the pixel circuit includes a single switching transistor disposed commonly to said three pixels for connecting the drive transistors of said pixels to said power supply line within the light emission period, wherein the switching transistor is configured to provide a correction period corresponding to the three drive transistors, and wherein the correction period begins when the switching transistor is turned on and ends when a given one of the sampling transistors turns off.

2. The pixel circuit according to claim 1, wherein said switching transistor is connected to the three drive transistors of the three pixels with a multi-layer wiring line.

3. A pixel circuit, comprising:

three pixels to which three primary colors are allocated;

a power supply line;

wherein each of said three pixels includes a sampling transistor configured to sample an image signal, a retaining capacitor configured to retain the sampled image signal, a drive transistor configured to output drive current corresponding to the retained image signal within a predetermined light emission period, and a light emitting element configured to emit light in the color allocated to said three pixels in response to the drive current, and the pixel circuit includes a single switching transistor disposed commonly to said three pixels for connecting the drive transistors of said pixels to said power supply line within the light emission period, wherein said pixels include different supplementary capacitors having capacitance values different from each other for supplementing the retaining capacitors; and said switching transistor is disposed in that one of said pixels which includes the supplementary capacitor which has the lowest one of the capacitance values.

4. A display apparatus in the form of a panel, comprising:

a plurality of pixels arranged in a matrix in a unit of three pixels to which three primary colors are allocated;

a power supply line configured to supply power to said pixels;

wherein each of the three pixels to which the three primary colors are allocated includes a sampling transistor configured to sample an image signal, a retaining capacitor configured to retain the sampled image signal, a drive transistor configured to output drive current in response to the retained image signal within a predetermined light emission period, and a light emitting element configured to emit light in the color allocated to said three pixels in response to the drive current, and the display apparatus includes a single switching transistor disposed commonly to the three pixels and configured to connect the drive transistors of the three pixels to which the three primary colors are allocated to said power supply line within the light emission period, wherein the switching transistor is configured to provide a correction period corresponding to the three drive transistors, and wherein the correction period begins when the switching transistor is turned on and ends when a given one of the sampling transistors turns off.

5. The display apparatus according to claim 4, wherein the switching transistor is connected to the three drive transistors of the three pixels with a multi-layer wiring line.

6. A display apparatus in the form of a panel, comprising:

a plurality of pixels arranged in a matrix in a unit of three pixels to which three primary colors are allocated;

a power supply line configured to supply power to said pixels;

wherein each of the three pixels to which the three primary colors are allocated includes a sampling transistor configured to sample an image signal, a retaining capacitor configured to retain the sampled image signal, a drive transistor configured to output drive current in response to the retained image signal within a predetermined light emission period, and a light emitting element configured to emit light in the color allocated to said three pixels in response to the drive current, and the display apparatus includes a single switching transistor disposed commonly to the three pixels and configured to connect the drive transistors of the three pixels to which the three primary colors are allocated to said power supply line within the light emission period, wherein the three pixels to which the three primary colors are allocated include different supplementary capacitances having capacitance values different from each other for supplementing the retaining capacitors, and the switching transistor is disposed in that one of the three pixels which includes the supplementary capacitance which has the lowest one of the capacitance values.

7. A pixel circuit comprising:

three pixels to which three primary colors are allocated;

a power supply line;

wherein each of said three pixels includes a sampling transistor configured to sample an image signal, a retaining capacitor configured to retain the sampled image signal, a drive transistor configured to output drive current corresponding to the retained image signal within a predetermined light emission period, and a light emitting element configured to emit light in the color allocated to said three pixels in response to the drive current, and the pixel circuit includes a single switching transistor disposed commonly to said three pixels for connecting the drive transistors of said pixels to said power supply line within the light emission period, wherein the switching transistor is configured to provide a correction period corresponding to the three drive transistors, and wherein the correction period is a mobility correction period.

8. A display apparatus in the form of a panel, comprising:

a plurality of pixels arranged in a matrix in a unit of three pixels to which three primary colors are allocated;

a power supply line configured to supply power to said pixels;

wherein each of the three pixels to which the three primary colors are allocated includes a sampling transistor configured to sample an image signal, a retaining capacitor configured to retain the sampled image signal, a drive transistor configured to output drive current in response to the retained image signal within a predetermined light emission period, and a light emitting element configured to emit light in the color allocated to said three pixels in response to the drive current, and the display apparatus includes a single switching transistor disposed commonly to the three pixels and configured to connect the drive transistors of the three pixels to which the three primary colors are allocated to said power supply line within the light emission period, wherein the switching transistor is configured to provide a correction period corresponding to the three drive transistors, and wherein the correction period is a mobility correction period.

* * * * *